United States Patent [19]

Gilles

[11] 3,949,808

[45] Apr. 13, 1976

[54] AIR CONDITIONING APPARATUS

[75] Inventor: Theodore C. Gilles, Marshalltown, Iowa

[73] Assignee: Lennox Industries, Inc., Marshalltown, Iowa

[22] Filed: Jan. 22, 1975

[21] Appl. No.: 543,186

[52] U.S. Cl. ..... 165/22; 165/48; 165/50; 98/40 DL

[51] Int. Cl.[2] ..... F24F 7/00

[58] Field of Search ..... 98/40 DL; 165/48, 50, 22

[56] References Cited

UNITED STATES PATENTS

| | | | |
|---|---|---|---|
| 3,114,505 | 12/1963 | Kennedy | 98/40 DL |
| 3,354,946 | 11/1967 | Dean, Jr. | 98/40 DL |
| 3,841,393 | 10/1974 | Gilles | 165/22 |

*Primary Examiner*—Albert W. Davis, Jr.
*Assistant Examiner*—James D. Liles
*Attorney, Agent, or Firm*—Allegretti, Newitt, Witcoff & McAndrews

[57] ABSTRACT

The present invention pertains to an air processing system for an enclosed area that includes a plenum, an air processing unit communicating with the plenum and responsive to a temperature sensing means, air-passing light fixtures for lighting the enclosed area, duct means through which the air processing unit receives return air via two separate paths, one being in heat exchange relationship with the light fixtures, damper means for controlling the passage of air through the duct means, and exhaust means for exhausting air from the plenum to the atmosphere. The damper means are constructed and arranged so as to maximize the use of heat from the light fixtures whenever heat is required in the enclosed area and to discharge such heat from the light fixtures to the atmosphere in order to reduce the cooling requirement when cooling is required in the enclosed area.

9 Claims, 4 Drawing Figures

AIR CONDITIONING APPARATUS

BACKGROUND OF THE INVENTION

This invention relates generally to an air processing system, and more particularly, to a novel return air control system for use with a heating, cooling and ventilating unit for processing the air in an enclosed area.

Satisfactory processing of the air in an enclosed area requires that the air temperature be kept within a relatively small temperature range. Air processing requirements will, of course, vary with the thermal load in the enclosed area.

Although achieving the desirable control of the air temperature within an enclosed area, presently known air processing systems are inefficient in certain respects. For example, in some of the presently known systems, heat produced by lighting fixtures is virtually ignored. In the heating mode, a majority of the "heat of light" remains substantially localized about the lighting fixture, and it is not used to heat the "lived in" regions of the enclosed area. Thus, primary energy or mechanical heating is required, despite the fact that a substantial quantity of "free heat" is readily available within the enclosed area. This additional primary energy heating significantly increases the operating cost of the presently known air processing systems.

In the cooling mode, the "heat of light" is again ignored. No attempt is made to lessen its adverse effect on room temperature. Additional mechanical cooling is, therefore, required to overcome this "heat of light," which results in relatively high energy use and operating costs.

Additionally, outside air, in certain situations, provides an economical means for cooling an enclosed area. Many of the presently known air processing systems, however, are not properly equipped to use the outside air and instead mechanical cooling is utilized, with an attendant increase in operating costs.

Even in those systems equipped with "outside air cooling means," the inefficiencies, discussed above, limit this operation to periods of time when the outside air temperature is considerably below the desired room temperature. Generally speaking, the presently known systems can be operated in this mode only when the outside air temperature is less than about 56° F.

SUMMARY OF THE INVENTION

An object of the present invention is to provide a more efficient, less expensive air processing system, as compared with presently known air processing systems.

A further object of the present invention is to provide an improved air processing system wherein room and outside air conditions are used, whenever possible, to effect the processing of the room air, thereby reducing the operating costs of the air processing system.

Another object of the present invention is to provide an improved air processing system wherein the effect of adverse room air conditions is lessened, or alleviated, thereby reducing the amount of necessary mechanical air processing and the cost of such processing.

It is another object of the present invention to provide an improved air processing system wherein room air conditions, for example, the heat from light, and outside air conditions are utilized and controlled whereby the capacity of the air processing unit, and thus, the overall cost of the air processing system is reduced.

These objects and others which will become apparent from the detailed description which follows are accomplished by a novel return air system, including damper means, which controls the flow of air to the heating, cooling, and ventilating unit. This return air system allows the air processing system to (1) utilize conditions existing inside and outside the enclosed area in "pre-processing" the air and (2) alleviate the effect of such conditions when undesirable.

BRIEF DESCRIPTION OF THE DRAWINGS

A preferred embodiment of the present invention will be described in detail with the aid of the following drawing in which.

DESCRIPTION OF THE PREFERRED EMBODIMENT

Figure 1:
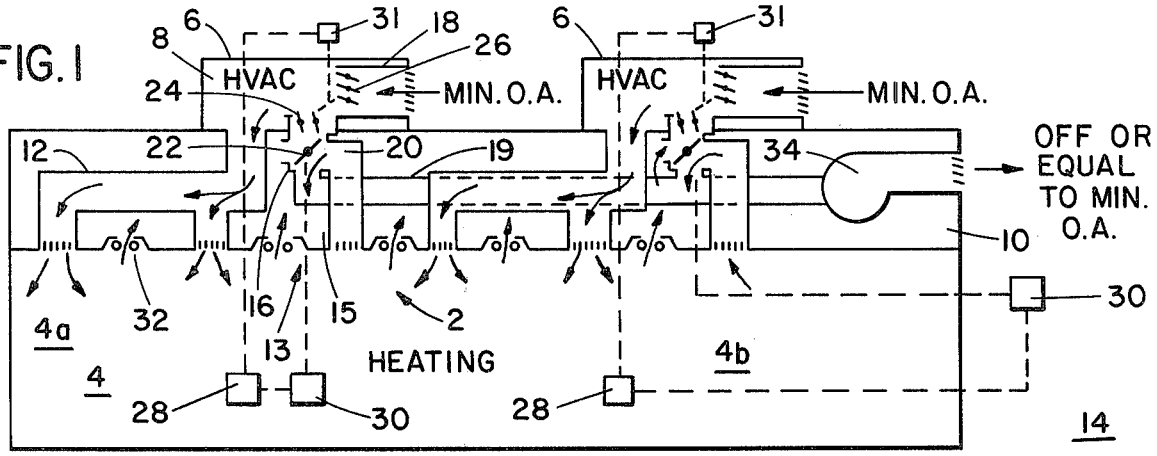
FIG. 1 shows a preferred embodiment of the present invention in the heating mode of operation.
Figure 2:
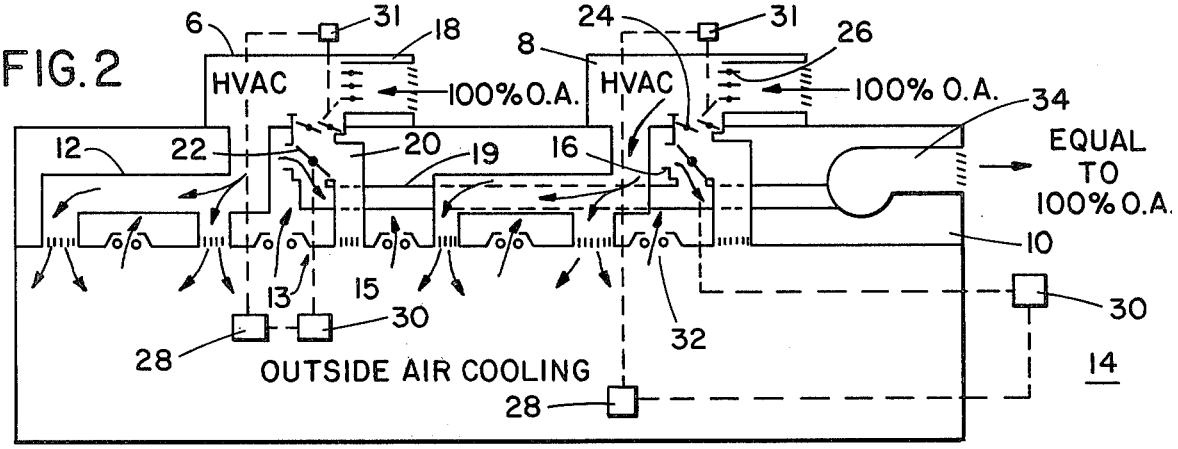
FIG. 2 shows the system of FIG. 1 in the nonmechanical cooling mode of operation.
Figure 3:
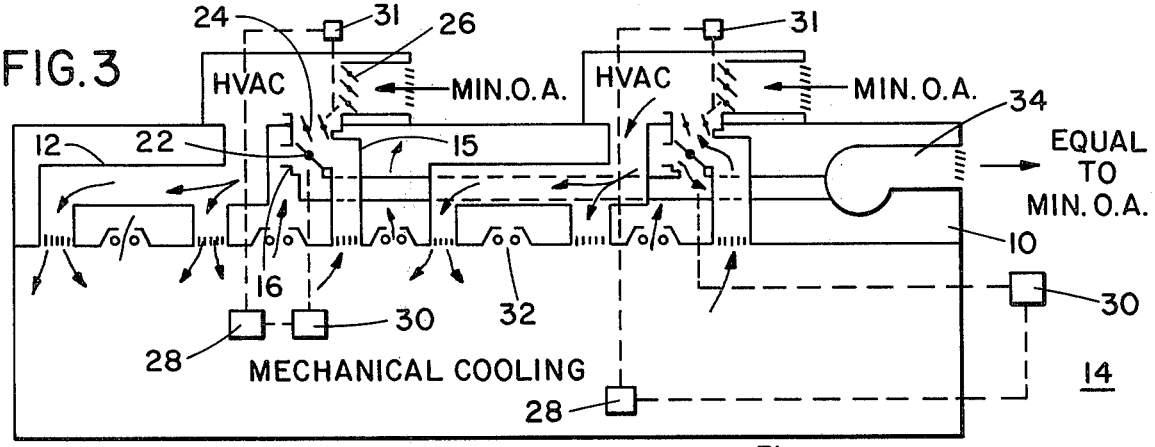
FIG. 3 shows the system of FIG. 1 in the mechanical cooling mode of operation.

Referring to FIGS. 1–3, a preferred embodiment of the present invention is shown as an air processing system, generally designated 2. The air processing system 2 conditions the air in an enclosed area or room 4, having temperature regions or zones *4a*, *4b*.

The air processing system 2 includes a pair of conventional heating, cooling and ventilating units 6 (hereinafter referred to as HVAC units 6) associated respectively with the zones *4a*, *4b*. It is to be understood that this embodiment of the invention is only illustrative and the air processing system may include any number of HVAC units 6. However, at least one HVAC unit 6 is required for each zone to be conditioned. Additionally, the HVAC units 6 and their operation are substantially identical and only one HVAC unit 6 will therefore be described in detail.

HVAC unit 6 is located on the roof, for example, and communicates with a plenum 10 such as the "sandwich space" between the ceiling and roof of a single story building (see FIG. 1) or between adjacent floors of a multi-story building (not shown). Processed air means or ducts 12 connect the HVAC unit 6 with the enclosed area 4 or, more particularly, the associated zone. Registers or volume balancing dampers may be provided in the outlets of the ducts 12.

A return air system, shown generally at 13, connects the air intake 8 of the HVAC unit 6 with the enclosed area 4, plenum 10, and the outside, shown generally at 14. These connections are made by room air means 15, plenum air means 16, and fresh or outdoor air means 18, respectively.

The return air system 13 also includes an exhaust air means or duct 19 and control means 20. As shown, the exhaust air means 19 of the HVAC units 6 are interconnected and communicate with the outdoors 14 through exhaust means or fan 34.

The control means 20 regulates and controls room air means 15, plenum air means 16, fresh air means 18 and exhaust air means 19. Control means 20 includes first damper means 22, second damper means 24 and third damper means 26. First damper means 22 selectively controls the flow of air from the enclosure 4 to the intake 8 through room air means 15 and plenum air means 16. Second damper means 24 regulates the amount of flow through the selected air means, i.e., room air means 15 or plenum air means 16 as controlled or selected by first damper means 22. Third damper means 26 regulates the flow of outdoor air through fresh air means 18.

Thus, the air entering the HVAC unit 6 through the air intake 8 may, at any time, consist of room air, outside fresh air, plenum air, or selected combinations thereof. As shown, air flowing in the "unselected" air means 15 or 16, as determined by first damper means 22, is exhausted from the enclosure 4 through exhaust air means 19.

The HVAC unit 6 and control means 20 are responsive to temperature sensing means 28. As shown schematically in FIG. 1, temperature sensing means 28 is a conventional thermostat disposed in the area to be treated. However, a differential temperature sensor, i.e., one which senses the temperature difference between inside and outside air, could be utilized. In either case, temperature sensing means 28 controls the mode of operation of the HVAC unit 6 and the setting of control means 20.

Control means 20 is operable in three stages, depending upon the mode of the HVAC unit 6. In the heating mode (shown in FIG. 1), the damper means 22, 24 and 26 are positioned so that room air means 15 is open to and communicates with exhaust air means 19 and is closed to HVAC unit 6, plenum means 16 is adjustably open to HVAC unit 6 through damper means 24, and fresh air means 18 is adjustably opened by damper means 26. In the non-mechanical cooling mode (shown in FIG. 2), air flow through room air means 15 to the air intake 8 is variably controlled by second damper means 24, plenum air means 16 communicates directly with exhaust air means 19, and fresh air means 18 is variably controlled by third damper means 26. In the mechanical cooling mode (shown in FIG. 3), first damper means 22 effectively connects room air means 15 to the HVAC unit 6 and plenum air means 16 to exhaust air means 19. The flow through room air means 15 is adjustably controlled by second damper means 24, and fresh air means 18 is adjustably controlled by third damper means 26. As used herein, "adjustably open," "adjustably controlled" and derivatives thereof indicate predetermined damper settings, while "variably controlled," "variably open" and derivatives thereof indicate damper setting which vary with indoor and outdoor temperature conditions.

The damper means 22 is actuated by a first conventional motor 30 controlled by temperature sensing means 28. The damper means 24, 26 are actuated by a second motor 31. As schematically shown, the damper means 24, 26 are interconnected for conjoint operation in response to the motor 31, although each damper means 24, 26 may be separately actuated. Whether interconnected or not, the damper means 24, 26 operate conversely, i.e., as one damper means is opened towards the full open position, the other is closed by motor 31 operating in response to the temperature sensing means 28. As indicated above, first damper means 22 is operable to open either air means 15 or 16 to the air intake 8 of the HVAC unit 6, the other air means being open to the exhaust air means 19. The air flow to the air intake 8 from either air means 15 or 16 is regulated and controlled by second damper means 24.

The air processing system 2 also includes a series of air passing lighting fixtures 32. Air flows through the air passing lighting fixtures 32 from the enclosed area 4 into the plenum 10. With passage therethrough, the air absorbs the "heat of light" surrounding the fixtures 32 and is, in effect, "pre-heated," prior to receipt by the HVAC unit 6 or exhaustion to the outdoors 14.

As previously discussed, exhaust means 34 is a fan or a blower in communication with the atmosphere and exhaust air means 19. Thus, when exhaust means 34 is operating, the exhausted air is either drawn from the enclosed area 4 through the air passing lighting fixtures 32 and plenum air means 16 or through the room air means 15, depending upon the state of operation of first damper means 22. In low resistance applications, volume balance is substantially accomplished by gravity relief through exhaust air means 19.

In operation, temperature sensing means 28 determines and effects the necessary mode of operation for the HVAC unit 6 and appropriately actuates the control means 20 through motors 30, 31. In the heating mode, shown in FIG. 1, the majority of air entering the air intake 8 of the HVAC unit 6 comes from plenum 10. Third damper means 26 is actuated to a predetermined minimum outside air setting, permitting 0–15 percent fresh outside air to enter the air intake 8 for purposes of ventilation. Preferably, third damper means 26 allows 10 percent outside air. As damper means 24, 26 operate conversely, the remaining 90 percent of air entering the air intake 8 is drawn from the plenum 10. As shown, damper means 22 substantially precludes air flow through room air means 15 to the HVAC unit 6. Thus, the indoor or return air received by the HVAC unit 6 passes through the air passing lighting fixtures 32, absorbing "heat of light."

Pressure and volume balance are regulated and maintained by the exhaust of air from the enclosed area 4 through room air means 15 and exhaust air means 19. Exhaust means 34 is actuated as required.

The air flow pattern established in this mode of operation is a significant feature of the present invention. The air passing through the lighting fixtures 32, as indicated above, absorbs the "heat of light" which surrounds these lighting fixtures 32. Thus, the room air is "pre-processed," or "preheated," prior to entering the HVAC unit 6. This preliminary heating of the room air decreases the amount of primary energy heating required in the HVAC unit 6, thereby reducing the operating cost of the air processing system 2.

The air processing system 2 is shown in the nonmechanical cooling mode in FIG. 2. In this mode, the cooling of the enclosed area 4 is accomplished by up to 100% outside air and the mechanical cooling apparatus of HVAC unit 6 is inoperative. Under most temperature conditions, air drawn through room air means 15 and outdoor air will be mixed, in appropriate quantities, to effect cooling of the enclosed area 4. At 100% outside air cooling, as shown in FIG. 2, passage of return air from the enclosure 4 to the HVAC unit 6 is substantially avoided by the combination of damper means 22, 24.

This is also a significant feature of the present invention because approximately 60 percent of the "heat of light" is exhausted during non-mechanical cooling. More particularly, exhaust means 34 operates to compensate for the amount of outside air drawn through third damper means 26 by the HVAC unit 6, and the exhausted air is drawn from the enclosure 4 through air passing light fixtures 32 and plenum air means 16. The "heat of light" in the enclosure 4 is, therefore, substantially reduced.

With this heat removal, the air processing system 2 provides total non-mechanical cooling, i.e., 100 percent outside air cooling, up to outside air temperatures of 62° F or 63° F, as compared to the 56° F limit experienced with the presently known air processing systems. A substantial savings in the operating costs of the air processing system 2 is, therefore, realized.

When the enclosed area 4 requires mechanical cooling, as shown in FIG. 3, third damper means is actuated to the minimum outside air setting, and room or return air enters the air intake 8 of the HVAC unit 6 through the room air means 15, as adjustably controlled by second damper means 24. As such, the air processing system 2 is a substantially closed system.

Exhaust means 34 exhausts an amount of plenum air equal to the amount of outside air taken in through fresh air means 18. This exhausted air passes through the lighting fixtures 32, and thus, carries off much of the "heat of light."

Elimination of the "heat of light" in this mode substantially reduces the amount of mechanical cooling required by the HVAC unit 6, thereby further reducing the operating cost of the air processing system 2. In addition, the necessary air conditioning capacity of the HVAC unit 6 is reduced. That is, less cooling is required per square foot than with the presently known air processing system. Thus, a smaller and less expensive HVAC unit 6 may be utilized.

The air processing system 2 has been theoretically compared with a presently known system for a 100,000 square foot store in both Los Angeles, California and Dallas, Texas. Predicted energy savings are substantial: 31.9 and 68.4 percent savings for daytime and nighttime operation, respectively, in Los Angeles and 20.6 and 32.7 percent savings for daytime and nighttime operation, respectively, in Dallas.

Another advantage of the present invention results from the continuous ventilation of the lighting fixtures 32. This ventilation increases the output of the lighting fixtures 10 to 20 percent, as compared with unvented fixtures.

Figure 4:
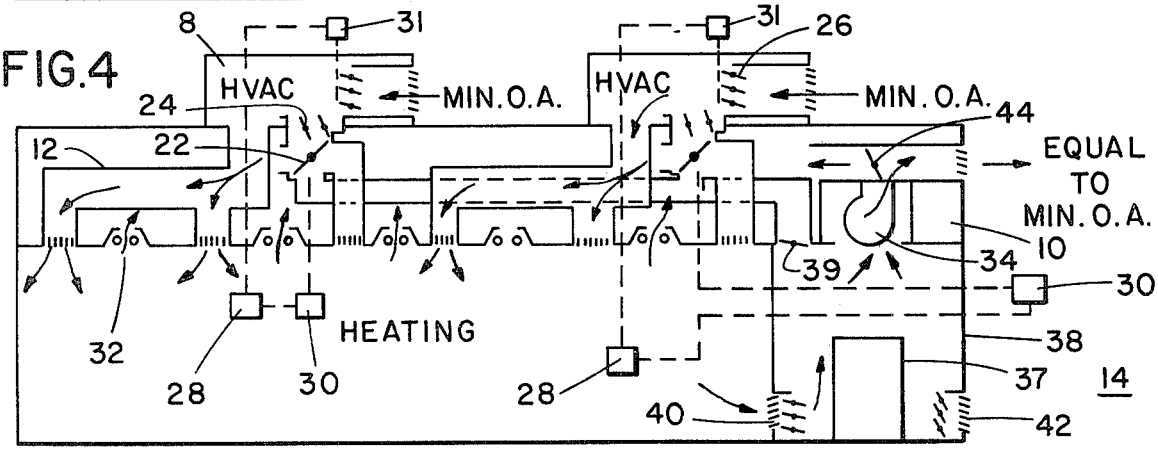
FIG. 4 shows a modification of the present invention in the heating mode incorporating a separate refrigeration condenser room.

The air processing system 2 is also adaptable for use in conjunction with other types of systems. For example, the air processing system 2 may be combined with a refrigeration system, as shown in FIG. 4. A significant feature of this combination is the recapture by the air processing system 2 of heat rejected by the refrigeration system (in a supermarket, for example). The refrigeration system, generally designated 37, is located within a condenser room 38.

As shown, the exhaust air means 19 communicates directly with the condenser room 38 through a regulating damper 39. Air is also drawn into the condenser room 38 through an enclosure damper 40 and an outdoor damper 42. Exhaust means 34 communicates with the condenser room 38 to withdraw air therefrom, and the flow of exhausted air is controlled by control damper 44. More particularly, control damper 44 directs the exhausted air either to the plenum 10 or outdoors 14.

In the heating mode, dampers 39, 42 are closed, damper 40 is open and damper 44 directs towards the plenum 10. As such, the plenum 10 is further preheated by room air drawn through the relatively warm environment of the refrigeration condenser room 38. The amount of primary energy heating required to maintain the desired temperature in the enclosed area 4 is, therefore, further reduced.

An additional capability of the present invention is the clearing or removal of smoke from a selected enclosed area in a building. Suitable detectors (not shown) responsive to the presence of smoke (or a predetermined excessive temperature) in an enclosed area 4 are provided and override the thermostat means 28. The detectors are interconnected with exhaust means 34 and control means 20. When smoke is detected in the enclosed area, exhaust means 34 is fully activated to withdraw maximum air from the affected enclosed area and the outside air means 18 is fully opened to permit maximum flow of outside air to the enclosed area, thereby effecting maximum air turnover. There is a flow of outside air into adjacent areas with less withdrawal to avoid migration of smoke from the affected area into the adjacent areas.

In applications utilizing multiple HVAC units, it is often desirable to move "heat of light" from the core of the area being treated to the perimeter thereof. The HVAC unit or units 6 of the air processing system 2 in the core or central region of the building may, therefore, be adapted to receive return air only through the room air means 15, with the "heat of light" from the core being carried through the plenum 10 to the perimeter. There are less heat losses in the core region, and thus, core heat is transferred to the perimeter where higher heat losses are experienced. This, too, results in a significant savings in energy.

A presently known air processing system is described in my U.S. Pat. No. 3,841,393 and hereinafter referred to as the '393 system. The air processing system 2, herein disclosed, is an improvement of the '393 system.

Although effective, the '393 system incorporates and utilizes a wall gravity relief in the enclosed area 4. A wall gravity relief is, generally speaking, architecturally undesirable and aesthetically unpleasing. As well known, the wall gravity relief can become inoperative under various wind-pressure conditions.

Further, in multiple zone applications during mixed mode operation, the relief may be inadequate, especially in the central or core regions. Back pressures are, therefore, created which adversely effect the operation of the '393 system. For example, in the non-mechanical cooling mode, sufficient intake of outdoor air may be prohibited, causing the '393 system to switch to mechanical cooling. Additional barometric relief can be achieved through plenum air exhaust, but this is wasteful of plenum heat needed in other regions.

The lack of wall gravity reliefs substantially lessens the initial, first cost of the air processing system 2, as compared with the '393 system. Installation is also facilitated.

While there has been shown and described particular embodiments of the present invention, it is understood that changes and modifications can be made without departing from the true spirit and scope of the present invention, as defined in the following claims.

What is claimed is:

1. An air processing system for an enclosed area comprising, in combination:

a plenum;

temperature sensing means;

an air processing unit responsive to said temperature sensing means, said air processing unit having an air intake;

processed air means for directing processed air from said air processing unit to said enclosed area;

air passing light fixtures between said enclosed area and said plenum, whereby indoor air within said enclosed area passes in heat transfer relationship with said light fixtures into said plenum;

outdoor air means for directing fresh outdoor air to said air intake;

return air means for controlling the air received by said air processing unit from said enclosed area, said return air means including room air means for directing indoor air within said enclosed area to said air intake, plenum air means for directing plenum air within said plenum to said air intake, and exhaust air means in communication with said room air means and said plenum air means for exhausting air therefrom to the outdoors; and control means for regulating said fresh air means, said room air means, said plenum air means and said exhaust air means, said control means being responsive to said temperature sensing means.

2. An air processing system as claimed in claim 1 wherein said control means is operable in a heating state wherein said room air means communicates directly with said exhaust air means, said plenum air means and said outdoor air means are adjustably open to said air intake, air directed to said air processing unit by said plenum air means passing through said light fixtures, operable in a first cooling state wherein said room air means and said outdoor air means are variably open to said air intake and said plenum air means communicates directly with said exhaust air means, air exhausted through said exhaust air means passing through said light fixtures, and operable in a second cooling state wherein said room air means and said outdoor air means are adjustably open and communicate with said air intake, said plenum air means communicates directly with said exhaust air means.

3. An air processing system as claimed in claim 1 wherein said control means includes first, second and third damper means.

4. An air processing system as claimed in claim 3 wherein said first, second and third damper means are controlled by motor means responsive to said temperature sensing means.

5. An air processing system as claimed in claim 3 wherein said first damper means selectively controls communication of said room air means and said plenum air means with said air intake and said exhaust air means.

6. An air processing system as claimed in claim 3 wherein said second damper means regulates the flow of air through said room air means and said plenum air means to said air intake.

7. An air processing system as claimed in claim 3 wherein said third damper means controls the flow of air in said fresh air means.

8. An air processing system as claimed in claim 1 further comprising exhaust means in communication with said exhaust air means for producing a flow of air in said exhaust air means.

9. An air processing system as claimed in claim 8 wherein said exhaust means is a blower.

* * * * *